US007549892B2

(12) United States Patent
Sawyers et al.

(10) Patent No.: US 7,549,892 B2
(45) Date of Patent: Jun. 23, 2009

(54) ELECTRONIC DEVICE CONNECTOR SYSTEM

(75) Inventors: Thomas P. Sawyers, Hempstead, TX (US); Qijun Chen, Spring, TX (US); Earl W. Moore, Cypress, TX (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 11/799,401

(22) Filed: Apr. 30, 2007

(65) Prior Publication Data

US 2008/0268700 A1 Oct. 30, 2008

(51) Int. Cl.
*H01R 3/00* (2006.01)

(52) U.S. Cl. ..... 439/500

(58) Field of Classification Search ..... 439/500, 439/79, 80, 608, 695, 701, 712, 715, 716, 439/724

See application file for complete search history.

(56) References Cited

U.S. PATENT DOCUMENTS

| | | | | |
|---|---|---|---|---|
| 5,483,437 | A | 1/1996 | Tang | |
| 6,652,318 | B1 * | 11/2003 | Winings et al. | 439/608 |
| 7,047,339 | B2 | 5/2006 | Oakley | |
| 7,056,154 | B2 | 6/2006 | Washino | |
| 7,195,519 | B1 * | 3/2007 | McAlonis et al. | 439/608 |
| 7,390,200 | B2 * | 6/2008 | Shuey et al. | 439/79 |
| 2002/0176240 | A1 | 11/2002 | Hudson et al. | |
| 2004/0259403 | A1 | 12/2004 | Chang | |

* cited by examiner

*Primary Examiner*—Ross N Gushi

(57) ABSTRACT

An electronic device connector system, comprising a connector member having a plurality of spaced-apart conductive inserts, at least one of the plurality of spaced-apart inserts comprising a plurality of separate conductor portions.

24 Claims, 2 Drawing Sheets

ELECTRONIC DEVICE CONNECTOR SYSTEM

BACKGROUND

Electronic devices, such as laptop or notebook computers, comprise detachable battery housings having connector systems to facilitate transfer of power and data signals. Such connector systems comprise corresponding connectors that are assembled by inserting conductive inserts into standard pitch slots. Each conductive insert is configured to carry a signal such as, for example, a power signal or a data signal. However, in the event additional power and/or signal communication paths are necessary, the connector members, and its housing, must be modified to increase the width thereof to accommodate additional slots and inserts. Due to the limited amount of available space within battery housings and notebook computers, incorporating wider connector members is problematic.

DETAILED DESCRIPTION OF THE DRAWINGS

Figure 1:
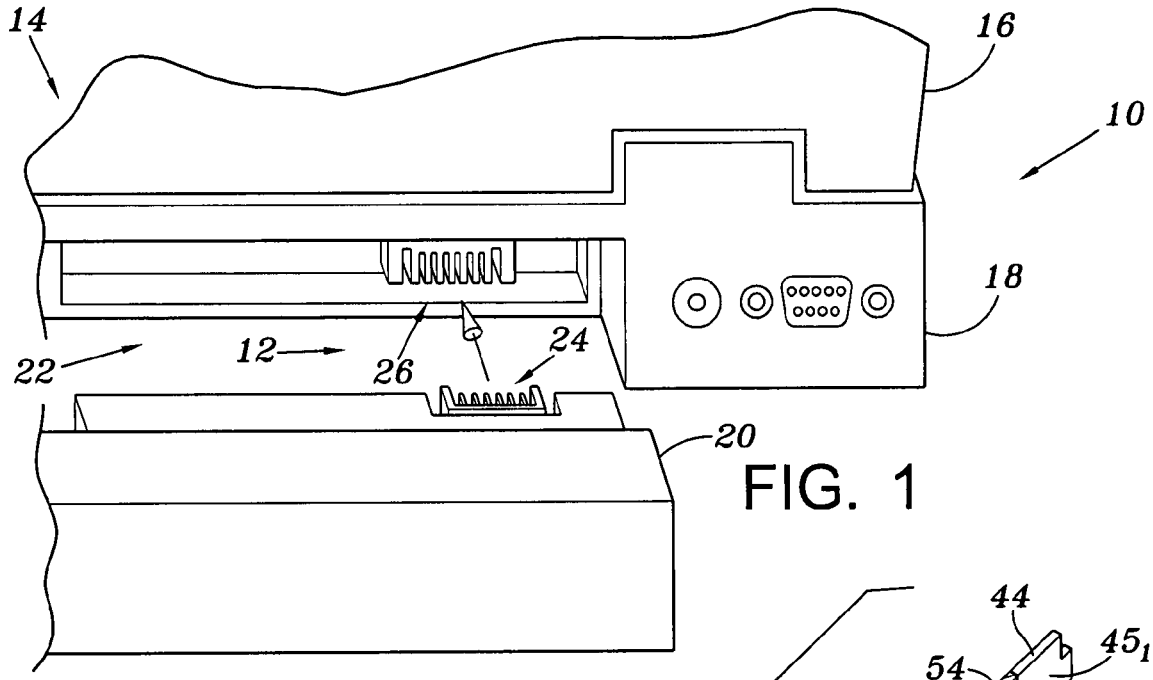
FIG. 1 is a diagram of an electronic device in which an embodiment of a connector system is employed to advantage.

FIG. 1 is a diagram illustrating an electronic device 10 in which an embodiment of a connector system 12 is employed to advantage. In the embodiment illustrated in FIG. 1, electronic device 10 comprises a laptop or notebook computer 14; however, it should be understood that electronic device 10 may comprise any type of electronic device such as, but not limited to, a tablet personal computer, a personal digital assistant, a gaming device, or any other type of portable or non-portable electronic device. In the embodiment illustrated in FIG. 1, electronic device 10 comprises a display member 16 coupled to a base member 18. In the embodiment illustrated in FIG. 1, electronic device 10 comprises a battery 20 insertible within a battery bay 22 of base member 18; however, it should be understood that battery bay 22 may be otherwise located (e.g., at any location on display member 16).

In the embodiment illustrated in FIG. 1, connector system 12 comprises a connector member 24 disposed on battery 20 and a corresponding connector member 26 disposed within battery bay 22 communicatively engageable to facilitate the transfer of power and data signals. For example, in the embodiment illustrated in FIG. 1, connector system 12 facilitates the transfer of high current signals, such as a power signal and a ground signal, while also facilitating the transfer of low current signals, such as one or more data signals, to enable battery 20 to transmit information to electronic device 10 such as, but not limited to, battery status information, voltage values, current values, temperature values, etc.

Figure 2:
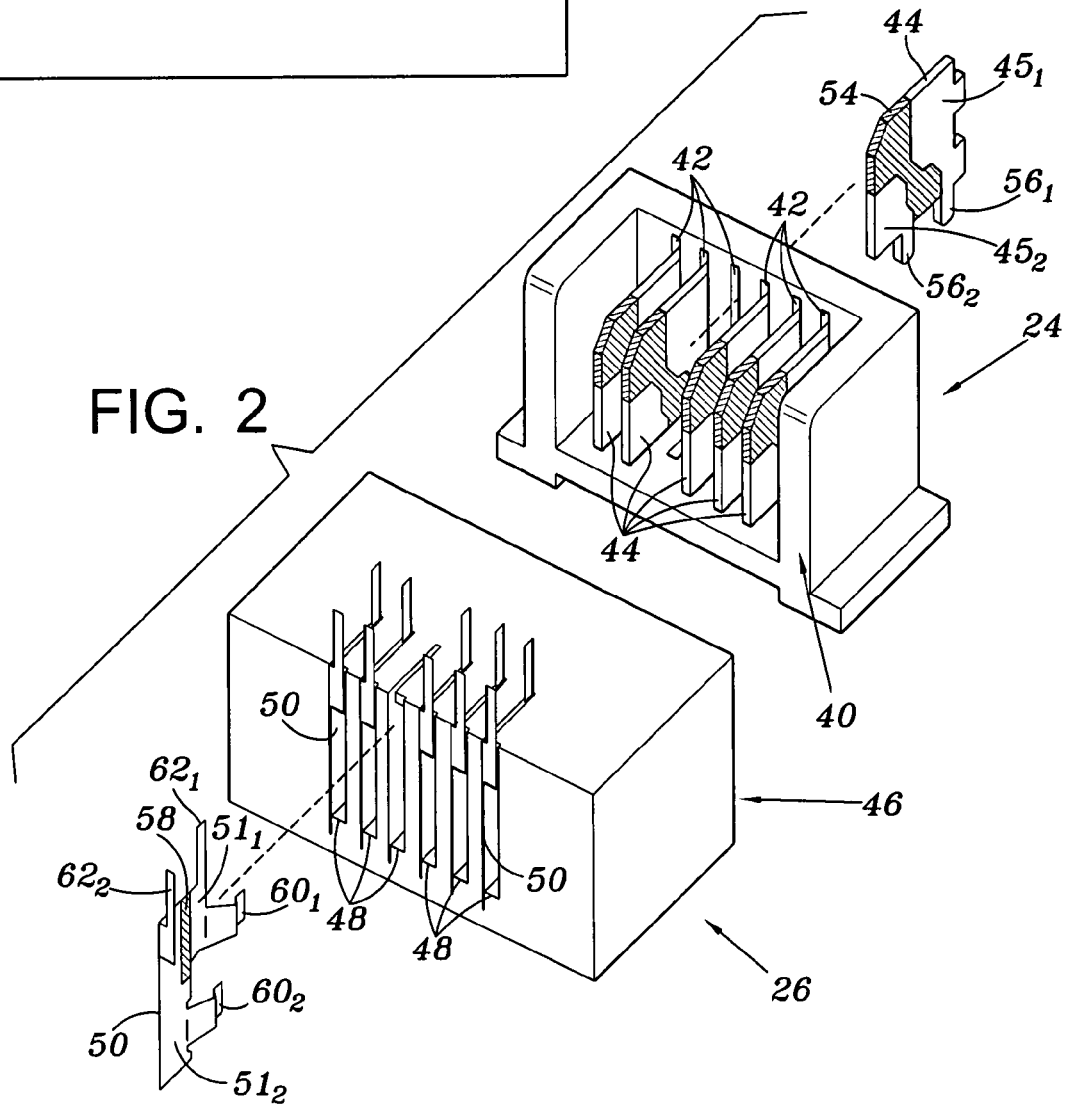
FIG. 2 is a diagram illustrating a partial exploded view of the connector system of FIG. 1.

FIG. 2 is a diagram illustrating a partial exploded view of connector system 12 of FIG. 1. In the embodiment illustrated in FIG. 2, connector member 24 comprises a housing 40 having a plurality of spaced-apart slots 42 each configured to receive and support a spaced-apart insert 44. Connector member 26 comprises a housing 46 having a plurality spaced-apart slots 48 each configured to receive and support a spaced-apart insert 50. In the embodiment illustrated in FIG. 2, one or more inserts 44 and 50 are configured to each transmit a plurality of signals to facilitate the manufacture of connectors with fewer slots, and thus smaller in size, and/or to facilitate the manufacture of connectors having a greater signal carrying capacity without modifications to housings 40 and 46 (e.g., widening housings 40 and 46 to accommodate additional inserts).

In FIG. 2, in some embodiments, inserts 44 and 50 are removably coupleable to housings 40 and 46 to facilitate interchangeability of inserts 44 and 50 with different sizes and/or types of inserts and/or for maintenance or repair of inserts without requiring modification of housings 40 and/or 46. According to some embodiments, inserts 44 and 50 are secured within housings 40 and 46 by frictional engagement; however, it should be understood that other methods of securing inserts 44 and 50 within housings 40 and 46 may be used (e.g., using an adhesive, snapping in place, soldering, etc.). In the embodiment illustrated in FIGS. 1 and 2, connector 24 is disposed within battery 20 and connector 26 is disposed within electronic device 10; however, it should be understood that connectors 24 and 26 may be otherwise disposed (e.g., connector 24 disposed within electronic device 10 and connector 26 disposed within battery 20). In FIG. 2, housings 40 and 46 comprise six spaced-apart slots 42 and 48 configured to receive inserts 44 and 50, respectively; however, it should be understood that housings 40 and 46 may be otherwise manufactured with a greater or fewer number of slots 40 and 46 and corresponding inserts 44 and 50, respectively.

In the embodiment illustrated in FIG. 2, insert 44 comprises an insulator portion 54 configured to form at least two separated/and or discrete conductor portions $\mathbf{45}_1$ and $\mathbf{45}_2$ on insert 44. In the embodiment illustrated in FIG. 2, two conductor portions $\mathbf{45}_1$ and $\mathbf{45}_2$ are illustrated; however, it should be understood that a greater or fewer number of conductor portions 45 may be utilized. In FIG. 2, each conductor portion $\mathbf{45}_1$ and $\mathbf{45}_2$ comprises at least one lead $\mathbf{56}_1$ and $\mathbf{56}_2$, respectively, to couple conductor portions $\mathbf{45}_1$ and $\mathbf{45}_2$ to a printed circuit board disposed within battery 20. In FIG. 2, each conductor portion $\mathbf{45}_1$ and $\mathbf{45}_2$ is configured to carry a separate signal. For example, conductor portion $\mathbf{45}_1$ may be rated for a six amp current capacity for transferring power to electronic device 10 while conductor portion $\mathbf{45}_2$ may be rated for a 0.1 amp current capacity to facilitate transfer of data signals to electronic device 10. It should be understood that each insert 44 may be otherwise configured. For example, in the embodiment illustrated in FIG. 2, a particular insert may comprise a conductor portion $\mathbf{45}_1$ rated for three amp current capacity and a conductor portion $\mathbf{45}_2$ rated for a 0.5 amp current capacity, while another insert 44 disposed within housing 40 may comprise conductor portions $\mathbf{45}_1$ and $\mathbf{45}_2$ rated for a 0.5 current capacity and a 0.2 amp current capacity, respectively. In other embodiments, it should be understood that one or more of inserts 44 may comprise a single conductor portion $\mathbf{45}_1$ rated to for a single current capacity (e.g., a seven amp current capacity).

In the embodiment illustrated in FIG. 2, one or more inserts 50 each comprise plurality of conductor portions $\mathbf{51}_1$ and $\mathbf{51}_2$ separated by an insulator 58. In the embodiment illustrated in FIG. 2, two conductor portions $\mathbf{51}_1$ and $\mathbf{51}_2$ are illustrated; however, it should be understood that a greater or fewer number of conductor portions $\mathbf{51}_1$ and $\mathbf{51}_2$ may be utilized on insert 50 so as to correspond to an insert 44 disposed within connector housing 40. In FIG. 2, conductor portions $\mathbf{51}_1$ and $\mathbf{51}_2$ each comprise a finger $\mathbf{60}_1$ and $\mathbf{60}_2$ outwardly extending from conductor portions $\mathbf{51}_1$ and $\mathbf{51}_2$, respectively, such that when connectors 24 and 26 are communicatively coupled together, fingers $\mathbf{60}_1$ and $\mathbf{60}_2$ contact conductors $\mathbf{45}_1$ and $\mathbf{45}_2$ on insert 44, respectively, to facilitate communicative engagement between inserts 44 and 50. In the embodiment illustrated in FIG. 2, conductors $\mathbf{51}_1$ and $\mathbf{51}_2$ each comprise a lead $\mathbf{62}_1$ and $\mathbf{62}_2$, respectively, for communicatively coupling insert 50 to a printed circuit board disposed within electronic device 10. In the embodiment illustrated in FIG. 2, conductor portions $\mathbf{51}_1$ and $\mathbf{51}_2$ are rated to transfer signals corresponding to a set of corresponding conductor portions $\mathbf{45}_1$ and $\mathbf{45}_2$. For example, in the event conductor portions $\mathbf{45}_1$ and $\mathbf{45}_2$ are rated for a 0.5 current capacity and a 0.2 amp current capacity, respectively, conductor portions $\mathbf{51}_1$ and $\mathbf{51}_2$ are rated to at least carry a 0.5 current capacity and a 0.2 amp current capacity, respectively.

Figure 3A:
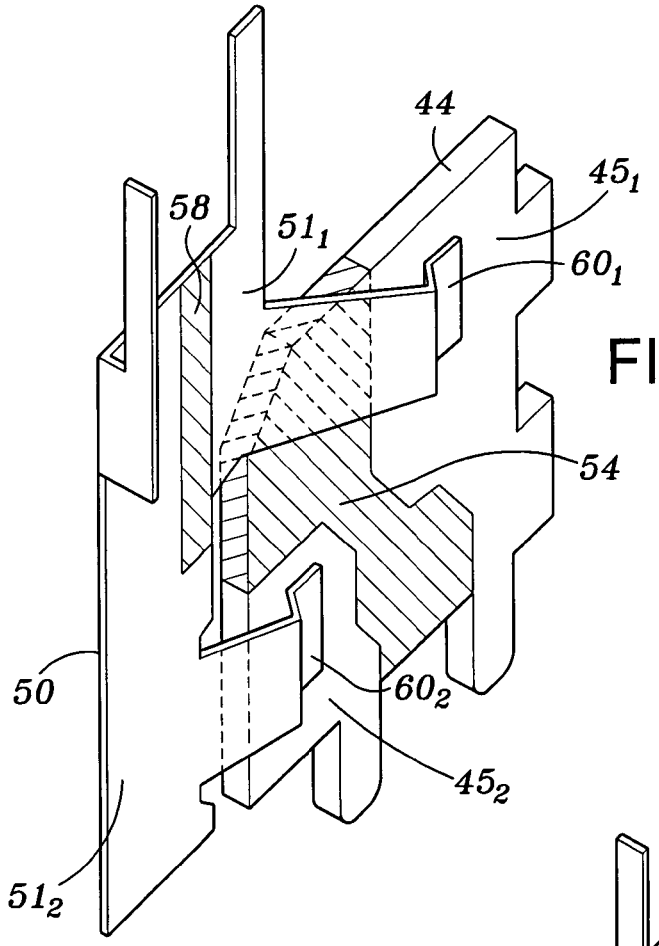
FIG. 3A is a diagram illustrating a pair of inserts of the connector system of FIGS. 1 and 2.

FIG. 3A is a diagram illustrating inserts 44 and 50 of connector system 12 of FIGS. 1 and 2. In the embodiment illustrated in FIG. 3A, inserts 44 and 50 are configured such that finger $\mathbf{60}_1$ is positioned to contact conductor portion $\mathbf{45}_1$. Thus, during operation, current travels between battery 20 to electronic device 10 via finger $\mathbf{60}_1$ so as to communicatively engage conductor portion $\mathbf{51}_1$ on insert 50. Similarly, a different current travels between battery 20 to electronic device 10 via finger $\mathbf{60}_2$ so as to communicatively engage conductor portion $\mathbf{51}_2$ on insert 50.

Figure 3B:
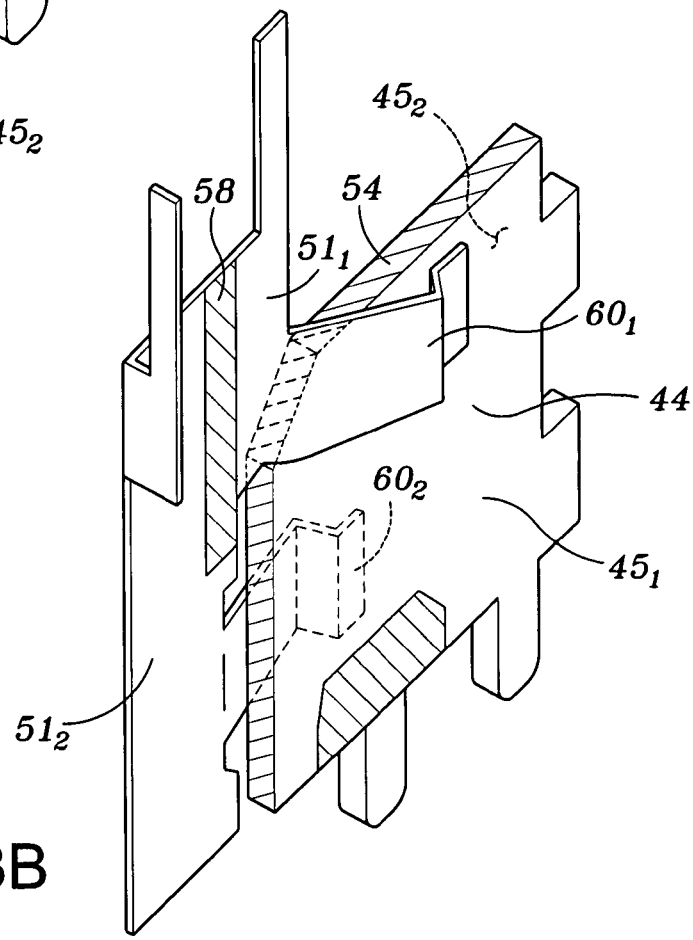
FIG. 3B is a diagram illustrating another embodiment of a pair of inserts of the connector system of FIGS. 1 and 2.

FIG. 3B is a diagram illustrating another embodiment of inserts 44 and 50 of connector system 12 of FIGS. 1 and 2. In the embodiment illustrated in FIG. 3B, insert 44 comprises insulator 54 sandwiched between conductors $\mathbf{45}_1$ and $\mathbf{45}_2$ forming a multi-layer insert 44 to isolate conductors $\mathbf{45}_1$ and $\mathbf{45}_2$. Thus, insert 44 is aligned with and inserted between fingers $\mathbf{60}_1$ and $\mathbf{60}_2$ to facilitate contact between fingers $\mathbf{60}_1$ and $\mathbf{60}_2$ with conductors $\mathbf{45}_1$ and $\mathbf{45}_2$ to enable communicative contact between inserts 44 and 50.

According to some embodiments, inserts 44 and 50 are formed of a metal, copper or any other type of conductive material; however, it should be understood that inserts 44 and/or 50 may be otherwise configured. For example, inserts 44 and/or 50 may be formed of a plastic material coated with a conductive substance (e.g., copper), formed from a plastic material with separate conductors coupled thereto, etc.

Embodiments of a connector system 12 can be manufacturing by providing a connector member having a plurality of inserts, at least one of the plurality of inserts comprising a plurality of separate conductor portions. The connector system 12 may also be manufactured by providing an insulator portion separating the plurality of conductors. The connector system 12 may also be manufactured by sandwiching a conductor between the plurality of conductors. The connector system 12 may also be manufactured by providing a plurality of corresponding inserts disposed on another connector member, at least one of the plurality of corresponding inserts comprising a plurality of separate conductor portions for communicative engagement with the at least one of the plurality of inserts. The connector system 12 may also be manufactured by providing a plurality of fingers on the plurality of corresponding inserts for communicative engagement with the at least one of the plurality of inserts.

Thus, embodiments of a connector system 12 can be manufactured having inserts 44 and 50 having a plurality of conductors $\mathbf{45}_1$, $\mathbf{45}_2$, and $\mathbf{51}_1$, $\mathbf{51}_2$ respectively, configured to carry at least two different currents. Furthermore, embodiments of connector system 12 are manufactured to enable easy interchangeability of inserts 44 and 50 in connector system 12.

What is claimed is:

1. An electronic device, comprising:

a display;

a base coupled to the display and including a base connector member; and a battery removably connectable to the base and including a battery connector member that engages the base connector member to transfer power to the electronic device, wherein the base connector member or the battery connector member includes plural removable inserts with plural separate conductor portions that carry separate signals.

2. The electronic device of claim 1, wherein both the base and battery connector members include plural inserts that are removable from slots.

3. The electronic device of claim 1, wherein the base connector member includes plural spaced-apart slots and plural inserts insertable into and removable from the plural spaced-apart slots.

4. The electronic device of claim 1, wherein the inserts have a first conductor portion that transfers power from the battery to the electronic device and a second conductor portion that transfers data signals from the battery to the electronic device.

5. The electronic device of claim 1, wherein the electronic device is a notebook computer, and the base connector member includes inserts with two separate conductor portions as fingers.

6. A method of manufacturing an electronic device comprising:

providing a base that includes a base connector member; and providing a removable battery that includes a battery connector member that connects to the base connector member to transfer power to the electronic device, wherein the battery connector member includes a slot and a removable insert connected in the slot, the insert having separate conductors to carry separate signals.

7. The method of claim 6, wherein the insert transmits both power and data signals from the battery to the electronic device.

8. The method of claim 6, wherein the insert includes an insulator portion that separates the separate conductors into a first conductor rated for a first amp current capacity and a second conductor rated for a second amp current capacity.

9. The method of claim 6, wherein the battery connector member includes two conductive fingers that electrically connect to the separate conductors on the base connector member.

10. The method of claim 6, wherein the insert is removable from the battery connector member and interchangeable with another insert being a different size or a different type than the insert.

11. An electronic device , comprising:

base having a base connector member; and a removable battery having a battery connector member that electrically connects to the base connector member, wherein the base connector member includes a slot and an insert removable from the slot, the insert having separate electrical conductors to transmit separate signals between the battery and the electronic device.

12. The electronic device of claim 11, wherein the insert transfers both power and data signals from the battery to the electronic device.

13. The electronic device of claim 11, wherein the insert has a first electrically conductive finger that extends outwardly from one side of the insert and a second electrically conductive finger that extends outwardly from another side of the insert.

14. The electronic device of claim 11, wherein both the base connector member and the battery connector member include plural slots and plural inserts that removably couple to the plural slots.

15. The electronic device of claim 11, wherein the insert includes two separate and distinct conductor portions that carry different signals between the battery and the electronic device.

16. The electronic device of claim 11, wherein the insert includes two separate conductor portions that electrically connect with two separate conductor portions on an insert in the battery connector member.

17. The electronic device of claim 11, wherein both the base and battery connector members include plural slots and plural removable inserts from the plural slots, the plural removable inserts transfer signals between the battery and the electronic device.

18. The electronic device of claim 11, wherein both the base and battery connector members include plural slots that receive plural inserts, the plural inserts each having two conductor portions separated by an insulator portion.

19. The electronic device of claim 11, wherein the insert is removable and replaceable with another insert having a different size.

20. The electronic device of claim 11, wherein the insert is removable and replaceable with another insert being a different type.

21. An electronic device connector, comprising:

a display;

a base connected to the display and including a base connector member; and a removable battery that connects to the base and includes a battery connector member that electrically connects to the base connector member, wherein the base connector member and the battery connector member include plural slots and plural electrically conductive inserts inserted into the plural slots, the plural electrically conductive inserts having separate conductor portions that carry separate signals.

22. The electronic device of claim 21, wherein the plural electrically conductive inserts are removable and replaceable from the plural slots.

23. The electronic device of claim 21, wherein the plural electrically conductive inserts have two separate conductors separated by an insulator portion so a single one of the plural electrically conductive inserts transmits both power and data signals from the battery to the electronic device.

24. The electronic device of claim 21, wherein the plural electrically conductive inserts in the base connector member have two electrically conductive fingers that connect to two conductive portions on the plural electrically conductive inserts in the battery connector member.

* * * * *

UNITED STATES PATENT AND TRADEMARK OFFICE

CERTIFICATE OF CORRECTION

PATENT NO. : 7,549,892 B2
APPLICATION NO. : 11/799401
DATED : June 23, 2009
INVENTOR(S) : Thomas P. Sawyers et al.

It is certified that error appears in the above-identified patent and that said Letters Patent is hereby corrected as shown below:

In column 4, line 29, in Claim 6, delete "device" and insert -- device, --, therefor.

In column 6, line 4, in Claim 21, after "device" delete "connector".

Signed and Sealed this

Nineteenth Day of January, 2010

David J. Kappos

David J. Kappos
*Director of the United States Patent and Trademark Office*